US007572170B2

(12) United States Patent
Chang

(10) Patent No.: US 7,572,170 B2
(45) Date of Patent: Aug. 11, 2009

(54) LOW LOAD SWINGING MECHANISM FOR A SANDER

(75) Inventor: Chin-Feng Chang, Fang Yuan (TW)

(73) Assignee: Kingsand Machinery Ltd., Taichung Hsien (TW)

( * ) Notice: Subject to any disclaimer, the term of this patent is extended or adjusted under 35 U.S.C. 154(b) by 0 days.

(21) Appl. No.: 11/838,251

(22) Filed: Aug. 14, 2007

(65) Prior Publication Data

US 2009/0047879 A1 Feb. 19, 2009

(51) Int. Cl.
*B24B 7/06* (2006.01)

(52) U.S. Cl. ..... 451/11; 451/130

(58) Field of Classification Search ..... 451/124, 451/130, 120, 184, 182, 178, 11

See application file for complete search history.

(56) References Cited

U.S. PATENT DOCUMENTS 7,014,544 B2 * 3/2006 Huang ..... 451/124

* cited by examiner

*Primary Examiner*—Robert Rose
(74) *Attorney, Agent, or Firm*—Ming Chow; Sinorica, LLC

(57) ABSTRACT

The invention relates to a low load swinging mechanism for a sander. The sander includes a roller unit that has a positioning base provided with two sliding rails for contacting with a connecting member of a sliding base. The sliding rail has an arc surface and the connecting member possesses a corner groove recessed with a certain angle, so that the surface of the corner groove is to contact linearly with the arc surface of the sliding rail to reduce a great abrasion resistance as the sliding base is reciprocating on the positioning base, for upgrading grinding precision.

12 Claims, 6 Drawing Sheets

LOW LOAD SWINGING MECHANISM FOR A SANDER

BACKGROUND OF THE INVENTION

1. Field of the Invention

This invention relates to a sander, particularly to one provided with a low load swinging mechanism to upgrade grinding precision.

2. Description of the Prior Art

As shown in FIG. 1, a conventional roller unit 10 of a sander is composed of a positioning base 11, a driving source 12, a sliding base 13 and an emery cloth roller 14. The driving source 12 is installed at one side of the positioning base 11, able to activate the emery cloth roller 14 to rotate and the sliding base 13 to reciprocate along the positioning base 11. The positioning base 11 is provided with a pair of lower dovetail grooves 111 for engaging with a pair of upper dovetail grooves 131 provided in the sliding base 13, so as to enable the sliding base 13 to slide against the emery cloth roller 14 for carrying out sanding. However, as the contacting surface between the lower dovetail grooves 111 and the upper dovetail grooves 131 is so large that a great abrasion resistance is generated, the driving source 12 has to output much load to surpass such an abrasion, possible to prompt vibration to lower grinding precision.

SUMMARY OF THE INVENTION

The objective of this invention is to offer a low load swinging mechanism for a sander.

The sander includes a roller unit that is provided with a positioning base and a sliding base able to reciprocate on the positioning base. The sliding base is fixed pivotally with an emery cloth roller that is activated to rotate by a driving unit. And the sliding base can be also driven by the driving unit to move to and fro. The positioning base is provided with two sliding rails for contacting with a connecting member of the sliding base. The sliding rail has an arc surface and the connecting member possesses a corner groove recessed with a certain angle, so that the surface of the corner groove is to contact linearly with the arc surface of the sliding rail to reduce a great abrasion resistance as the sliding base is reciprocating on the positioning base. Thus, the driving unit can proceed with fewer loads so as to reduce vibration and its noise, for enhancing grinding precision.

BRIEF DESCRIPTION OF DRAWINGS

This invention is better understood by referring to the accompanying drawings, wherein.

DETAILED DESCRIPTION OF THE PREFERRED EMBODIMENT

Figure 1:
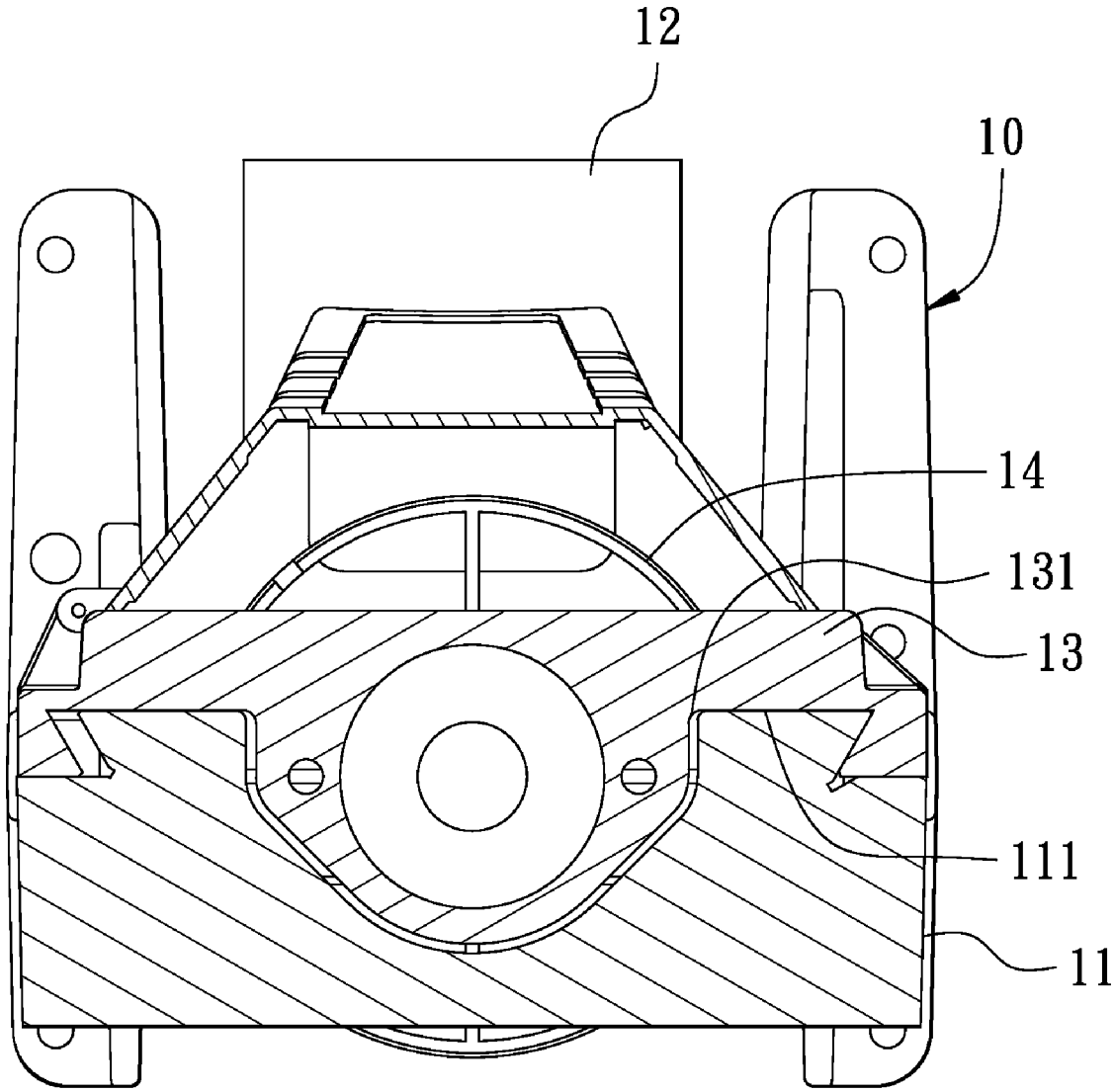
FIG. 1 PRIOR ART
FIG. 1 is a side cross-sectional view of a conventional roller sander.
Figure 2:
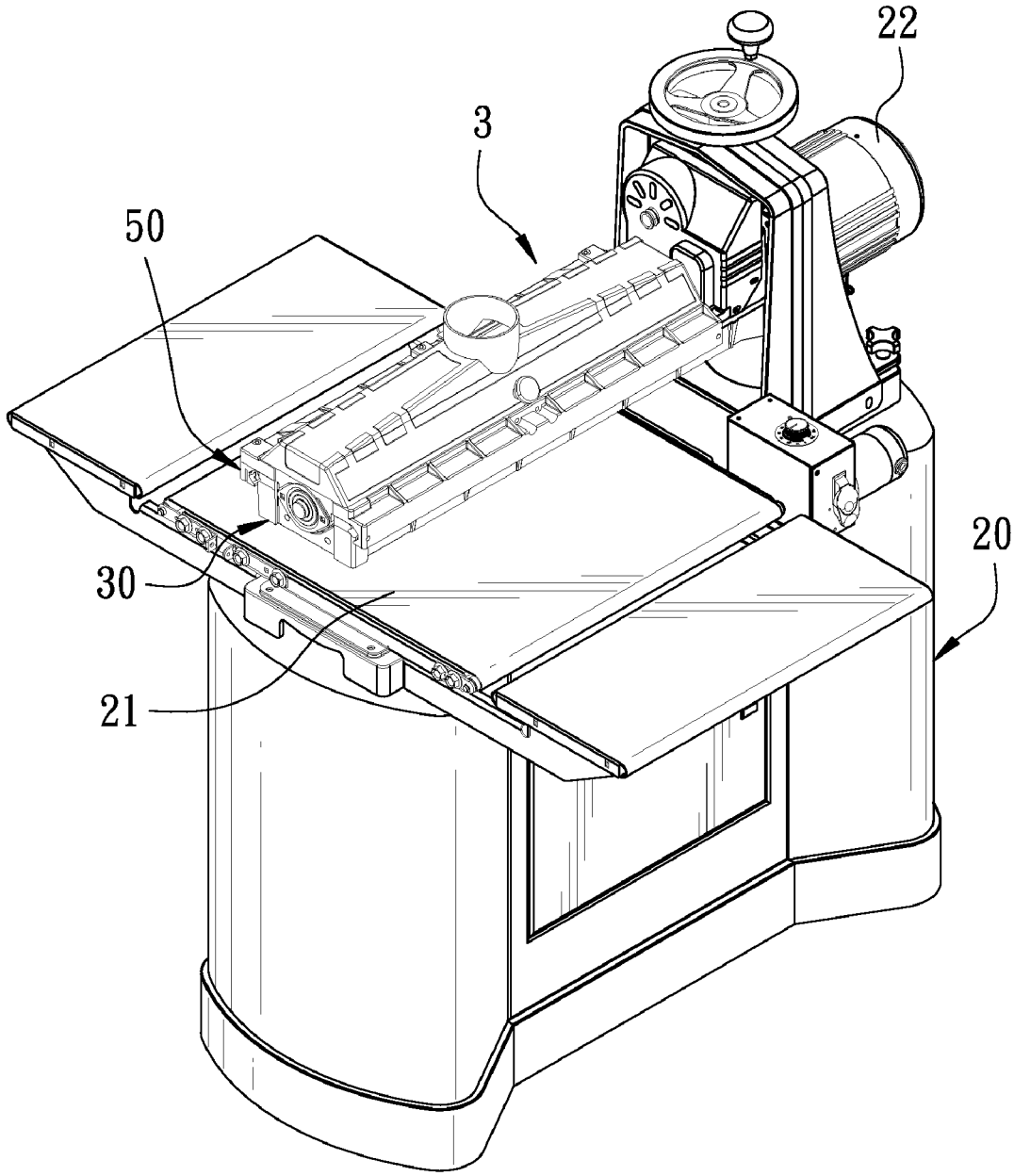
FIG. 2 is a perspective view of a preferred embodiment of a low load swinging mechanism for a sander in the present invention.
Figure 3:
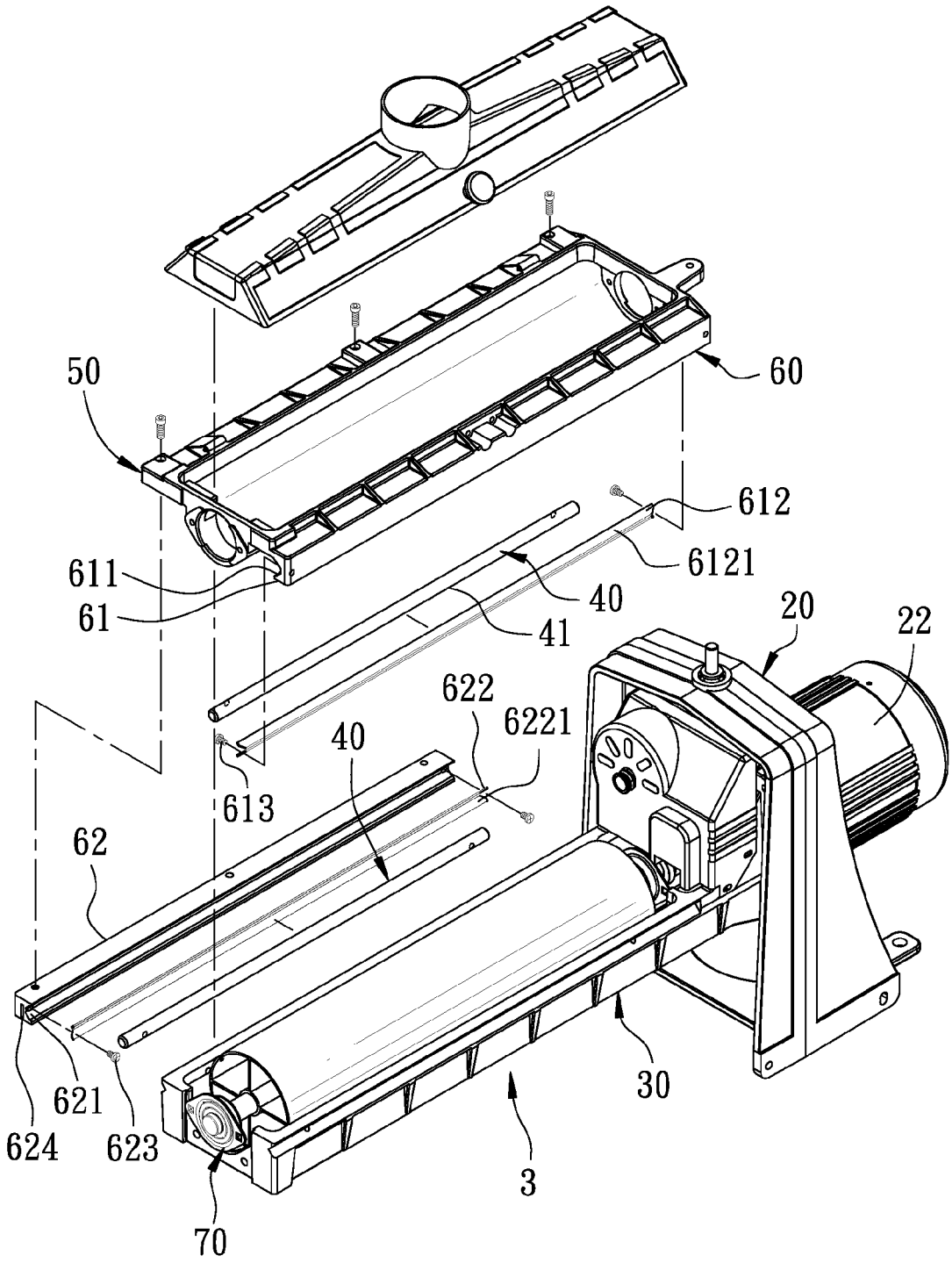
FIG. 3 is a partial exploded perspective view of the preferred embodiment of a low load swinging mechanism for a sander in the present invention.
Figure 4:
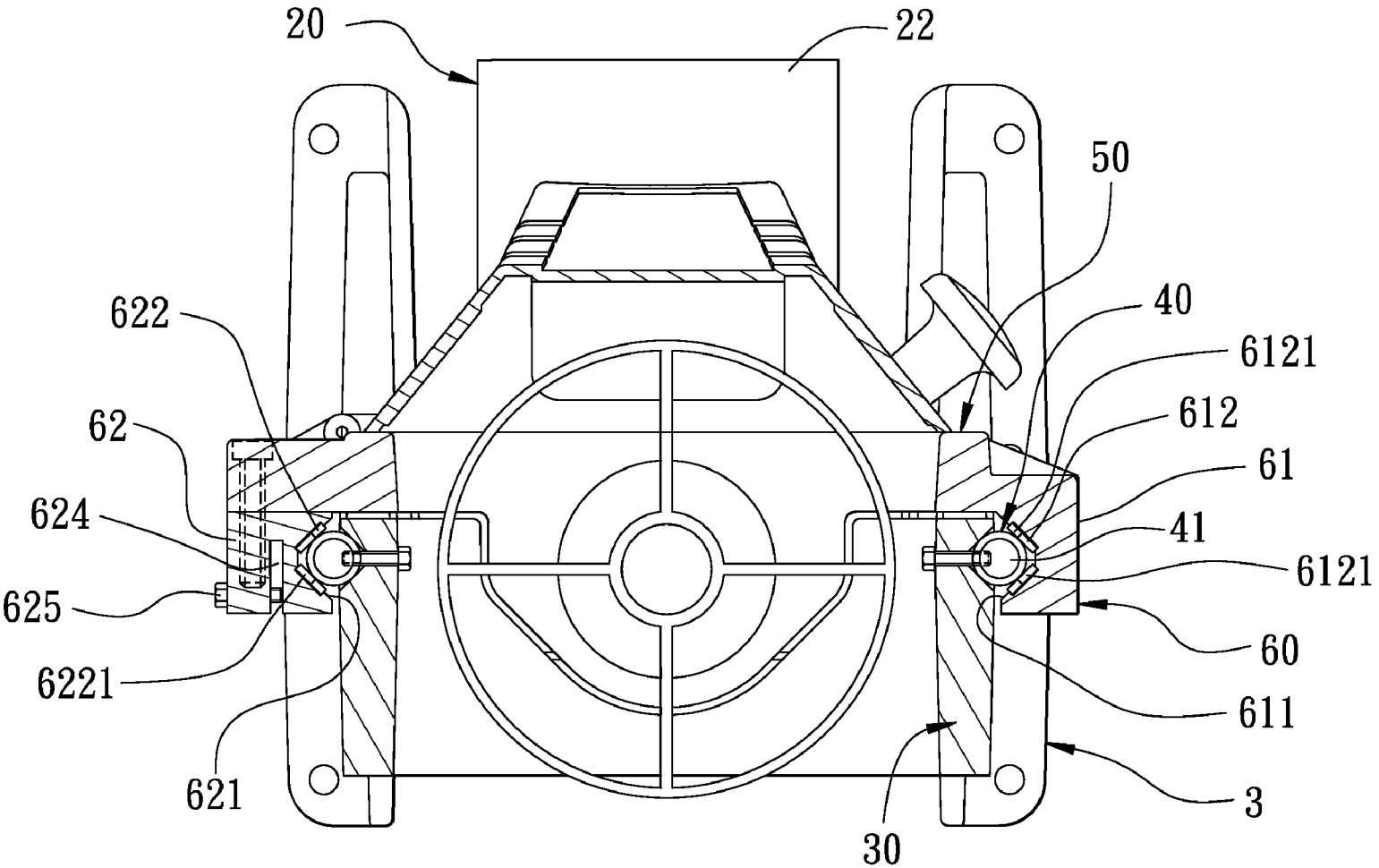
FIG. 4 is a side cross-sectional view of a roller unit of the preferred embodiment of a low load swinging mechanism for a sander in the present invention.

FIGS. 2~4 show a preferred embodiment of a low load swinging mechanism for a sander in the present invention. The sander is provided with a main base 20, a conveyer 21 installed above the base 20, a driving unit 22 positioned at one side of the conveyer 21, and a roller unit 3 extended axially from the driving unit 22 to be positioned above the conveyer 21 with a preset space. The roller unit 3 is composed of a positioning base 30, a sliding base 50 and an emery cloth roller 70.

The positioning base 30 is extended axially from the driving source 22 to be positioned above the conveyer 21 with a preset space, having its two long sides installed with a sliding rail 40 respectively. The sliding rail 40 is formed as a round bar, with an arc surface 41 facing to the longitudinal sides of the positioning base 30. Or, the sliding rail 40 is formed integrally together with the positioning base 30.

Figure 5:
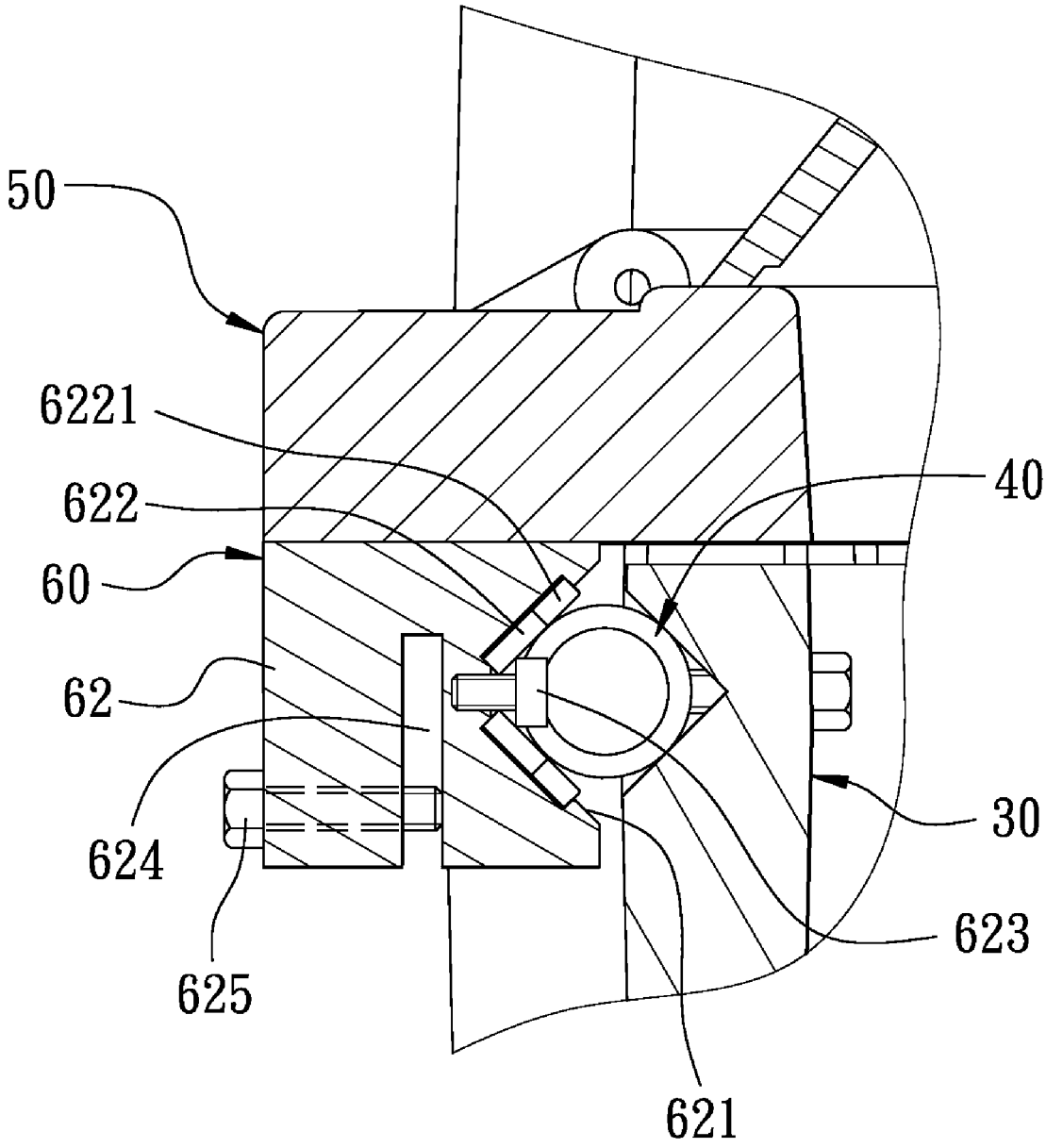
FIG. 5 is a partial side cross-sectional view of the roller unit of the preferred embodiment of a low load swinging mechanism for a sander in the present invention.
Figure 6:
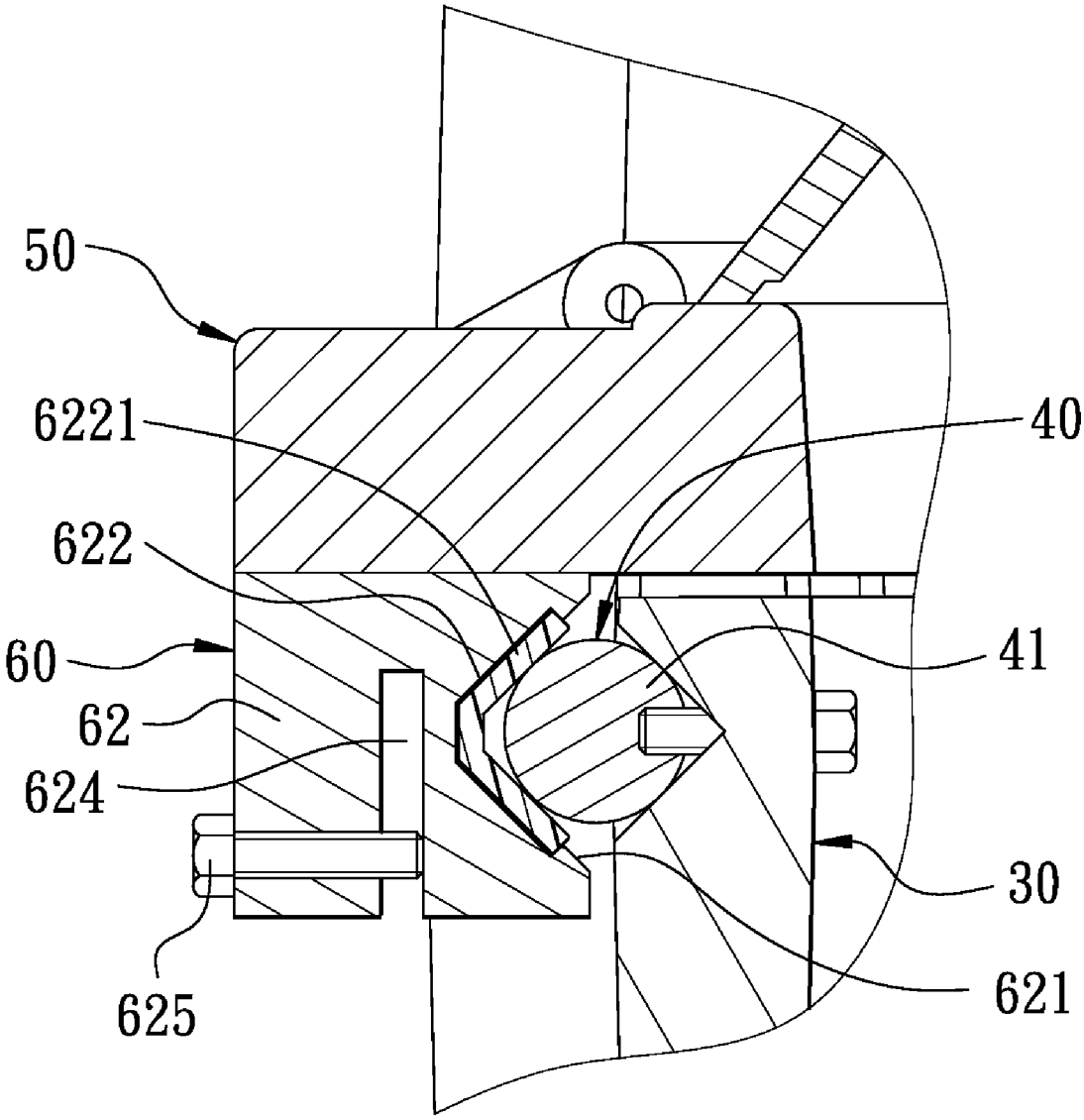
FIG. 6 is a partial side cross-sectional view of the roller unit of the preferred embodiment of a low load swinging mechanism for a sander in the present invention, showing a contacting member of a second connecting strip formed integrally together with a corner groove.

The sliding base 50 is axially mounted on the positioning base 30, provided with an connecting member 60 for contacting with the sliding rails 40 The connecting member 60 is provided with a first connecting strip 61, which is formed integrally from the right bottom of the sliding base 50, having a corner groove 611 concaved with two plane surfaces formed with a certain angle for contacting with the sliding rail 40. A contacting member 612 is provided in the plane surfaces of the corner groove 611 for contacting with the arc surface of the sliding rail 40, provided with two planar abrasion-resistant bars 6121 respectively adhered tightly on the plane surfaces of the corner groove 611. Also, the corner groove 611 is inserted by plural restricting screws 613 to keep two ends of the abrasion-resistant bars 6121 from deforming, which may lessen working precision. As shown in FIG. 5, the connecting member 60 is also provided with a second connecting strip 62, which is installed at the left bottom of the sliding base 50, formed as a long bar. The second connecting strip 62 is provided with a corner groove 621 concaved with two plane surfaces formed with a certain angle for contacting with the sliding rail 40. A contacting member 622 is provided in the plane surfaces of the corner groove 621 for contacting with the arc surface of the sliding rail 40, provided with two planar abrasion-resistant bars 6221 respectively adhered tightly on the plane surfaces of the corner groove 621. The corner groove 621 is in addition inserted by a restricting screw 623 to keep two ends of the abrasion-resistant bar 6121 from curling up. The second connecting strip 62 is also provided with an adjusting groove 624 formed behind the corner groove 621, and an adjusting bolt 625 screwed pivotally in the adjusting groove 624 so as to reciprocate therein to enable the corner groove 621 to micro-adjusted in its position. And, as shown in FIG. 6, the contacting member 622 is directly shaped the same as the corner groove 621 or formed integrally together with the corner groove 621. Thus, the sliding base 50 can slide along the positioning base 30 by means of linear contact with the sliding rails 40 and the engaging member 60.

The emery cloth roller 70 is axially fixed on the sliding base 50 pivotally, driven by the driving unit 22 to rotate.

In using, as shown in FIGS. 3~5, as the emery cloth roller 70 is activated to rotate by the driving unit 22, the sliding base 50 is synchronously driven by the driving unit 22 to horizontally reciprocate on the positioning base 30. By the time, the corner groove 611 of the first contacting strip 61 and the corner groove 621 of the second contacting strip 62 are respectively contacting linearly with the sliding rails 40, relatively reducing largely the contacting area between the positioning base 30 and the sliding base 50. That is, a great abrasion resistance created during to-and-fro movement of the sliding base 50 on the positioning base 30 is lessened so that the driving unit 22 can proceed with fewer loads at the time of starting or changing direction. Therefore, the sliding base 50 can smoothly reciprocate on the positioning base 30 to reduce vibration and its noise, for enhancing grinding precision.

The advantages of the invention are described below as can be seen from the foresaid description.

With the linear contact between the engaging member 60 of the sliding base 50 and the positioning base 30, the contacting area between the sliding base 50 and the positioning base 30 is minimized so that the driving unit 22 can proceed with fewer loads at the time of initiating the power or changing its moving direction. So, the sliding base 50 can smoothly reciprocate on the positioning base 30 to reduce vibration and its noise, for upgrading grinding precision.

While the preferred embodiment of the invention has been described above, it will be recognized and understood that various modifications may be made therein and the appended claims are intended to cover all such modifications that may fall within the spirit and scope of the invention.

What is claimed is:

1. A low load swinging mechanism for a sander, said sander comprising:

a main base provided with a conveyer installed above the main base and a driving unit positioned at one side of the main base; and a roller unit extended axially from said driving unit and being positioned above said conveyer with a preset space wherein the roller unit being provided with a positioning base;

a sliding base moves, driven by said driving unit, on said positioning base;

an emery cloth roller positioned on said sliding base and pivot driven by said driving unit;

said positioning base being provided with a sliding rail and installed at two sides of the positioning base respectively to contact with an engaging member provided in said sliding base; and each of said sliding rail formed with an arc surface for contacting with a corner groove that is concaved in said engaging member with a preset angle, and to keep said arc surface of said sliding rail only contacting linearly with said corner groove of said engaging member for reducing a contacting area between said positioning base and said sliding base.

2. The low load swinging mechanism for a sander as claimed in claim 1, wherein said positioning base has two long sides fixed respectively with said sliding rail; and said sliding base has two long sides fixed with said engaging member.

3. The low load swinging mechanism for a sander as claimed in claim 2, wherein both of said sliding rail are formed integrally together with said positioning base, with said arc surface positioned outside said positioning base.

4. The low load swinging mechanism for a sander as claimed in claim 2, wherein each of said sliding rail is formed as a round bar and connected on said positioning base with said arc surface positioned outside said positioning base.

5. The low load swinging mechanism for a sander as claimed in claim 2, wherein a connecting member is formed integrally together with said sliding base.

6. The low load swinging mechanism for a sander as claimed in claim 2, wherein said engaging member is formed as a long bar and connected with said sliding base.

7. The low load swinging mechanism for a sander as claimed in claim 1, wherein said connecting member is provided with an adjusting groove formed behind said corner groove, and a preset number of adjusting bolts screwed pivotally in said adjusting groove so as to reciprocate therein to enable said corner groove to be moved with a micro degree.

8. The low load swinging mechanism for a sander as claimed in claim 1, wherein said corner groove is provided with a contacting member located on surface of the corner groove for contacting with said arc surface of said sliding rail.

9. The low load swinging mechanism for a sander as claimed in claim 8, wherein said contacting member is an abrasion-resistant bar formed in a preset shape and fixed on said corner groove.

10. The low load swinging mechanism for a sander as claimed in claim 9, wherein said abrasion-resistant bar is composed of a plurality of planar bars and said corner groove is further provided with plural restricting screws used to keep two ends of said abrasion-resistant bar positioned immovably.

11. The low load swinging mechanism for a sander as claimed in claim 9, wherein said abrasion-resistant bar is shaped to match with said surface of said contacting member.

12. The low load swinging mechanism for a sander as claimed in claim 8, wherein said contacting member is formed integrally together with said corner groove.

* * * * *